US007114989B2

(12) United States Patent
Yin

(10) Patent No.: US 7,114,989 B2
(45) Date of Patent: Oct. 3, 2006

(54) COAXIAL ELECTRICAL CONNECTOR

(75) Inventor: Hongjun Yin, Wuxi (CH)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/545,065

(22) PCT Filed: Apr. 15, 2004

(86) PCT No.: PCT/US2004/011526

§ 371 (c)(1),
(2), (4) Date: Aug. 10, 2005

(87) PCT Pub. No.: WO2004/095652

PCT Pub. Date: Nov. 4, 2004

(65) Prior Publication Data

US 2006/0160427 A1 Jul. 20, 2006

(30) Foreign Application Priority Data

Apr. 18, 2003 (CH) ..... 2003 2 56509

(51) Int. Cl.
*H01R 9/05* (2006.01)

(52) U.S. Cl. ..... 439/578

(58) Field of Classification Search ..... 439/578, 439/581, 63, 733.1, 79, 579
See application file for complete search history.

(56) References Cited

U.S. PATENT DOCUMENTS 5,046,952 A * 9/1991 Cohen et al. ..... 439/63
5,112,249 A * 5/1992 Henry et al. ..... 439/581
5,882,210 A * 3/1999 Embo et al. ..... 439/63
6,382,999 B1 * 5/2002 Mou et al. ..... 439/188
6,551,115 B1 * 4/2003 Li et al. ..... 439/79

* cited by examiner

*Primary Examiner*—Chandrika Prasad
(74) *Attorney, Agent, or Firm*—Stephen Z. Weiss

(57) ABSTRACT

A coaxial electrical connector includes a dielectric housing having a front mating face and a rear face. A first, central terminal-receiving passage extends in a direction between the faces, along with at least one second, auxiliary terminal-receiving passage. At least one auxiliary terminal is received in the second passage. A center terminal is received in the first passage and includes an elongated mating portion projecting toward the mating face of the housing and defining a center axis. The elongated mating portion has a front mating end and a rear end. A terminating portion is spaced radially of the mating portion. A connecting portion joins the mating portion and the terminating portion. The connecting portion includes a stabilizing section which extends rearwardly along the axis from the rear end of the mating portion. The stabilizing section bears against a section of the first passage in the housing to stabilize the elongated mating portion of the center terminal.

6 Claims, 4 Drawing Sheets

COAXIAL ELECTRICAL CONNECTOR

FIELD OF THE INVENTION

This invention generally relates to the art of electrical connectors and, particularly, to a coaxial type electrical connector which has a center contact or terminal element.

BACKGROUND OF THE INVENTION

Coaxial electrical connectors are used in a wide variety of applications for transmitting direct current, such as in charger sockets for such devices as cellular telephones or the like. Such coaxial connectors include a center terminal and at least one auxiliary terminal spaced transversely or radially of the center terminal. Distal ends of the center terminal and the auxiliary terminal respectively mate with the positive and negative electrodes of a mating element such as a female coaxial connecting device. Opposite ends of the terminals may be connected, as by soldering, to appropriate circuit traces on a printed circuit board for transmitting current. In these connector arrangements, the center terminal is a critical component of the connector.

The terminals of such connectors typically are stamped and formed of conductive sheet metal material. In order to reduce the contact resistance of the coaxial connector to improve the stability of the circuit, the mating end of the center terminal is formed or rolled into a cylindrical configuration, and the terminating end of the center terminal is appropriately stamped and formed into a configuration for mounting the terminal and terminating the terminal, such as to the printed circuit board. Processing the cylindrical mating end of the terminal requires multi-axis rolling and forming technology which is complex and may result in inconsistent quality of the terminal and the connector. In addition, it is difficult to fix the center terminal in the housing of the connector without unduly increasing the size of the housing or affecting the stability of current transmission.

In an attempt to solve these various problems, FIG. 1 shows a coaxial connector, generally designated 10, as disclosed in Chinese Patent No. 01280613. The connector includes an insulating housing, generally designated 12; a center terminal, generally designated 14; and a pair of auxiliary terminals, generally designated 16 and 18. The center terminal is inserted into a passage 12*a* of housing 12; auxiliary terminal 16 is inserted into a passage 12*b* in the housing; and auxiliary terminal 18 is inserted into a passage 12*c* in the housing. Center terminal 14 includes a hollow cylindrical mating portion 14*a*, a solder tail portion 14*b* and a right-angled connecting portion 14*c* joining the mating portion to the solder tail portion. A pair of mounting interference wings 14*d* project outwardly from opposite sides of the center terminal generally at the right-angled connecting portion 14*c* thereof. The mounting interference wings have outwardly projecting teeth 14*e*.

Still referring to FIG. 1, when center terminal 14 is inserted into passage 12*a* in housing 12, the mounting interference wings 14*d* are inserted into a pair of slots 12*d* at opposite sides of passage 12*a* with an interference fit to hold the center terminal in the housing. However, since mounting wings 14*d* are plate-like members and their contact area with inner walls of the housing is rather small, the interference affect is rather small and it is difficult to ensure stable mounting of the center terminal. Unstable mounting will affect the stability of current transmission. The mounting interference wings cannot be made significantly larger to increase the holding affect on the center terminal without significantly increasing the size of housing 12 which would be undesirable.

FIG. 2 shows another coaxial cable, generally designated 20, according to the prior art. This connector includes an insulating housing, generally designated 22; a center terminal, generally designated 24; and a pair of auxiliary terminals, generally designated 26 and 28. The center terminal is inserted into a passage 22*a* in the housing, and the auxiliary terminals 26 and 28 are inserted into a pair of passages 22*b* and 22*c*, respectively, in the housing. Again, center terminal 24 has a cylindrical mating portion 24*a*, a solder tail portion 24*b* and a connecting portion 24*c* joining the cylindrical mating portion to the solder tail portion. The mating portion has a pair of resilient contact fingers 24*d* to enhance the contact engagement with a mating female connecting device. In order to improve the holding capabilities of center terminal 24 within housing 22, a pair of mounting interference hooks 24*e* are inclined outwardly from opposite sides of mating portion 24*a* near connecting portion 24*c*. Although hooks 24*e* (FIG. 2) might improve the stability of the center terminal versus wings 14*d* (FIG. 1), the improvement is rather small even when combined with any interference effect generated by connecting portion 24*c* with housing 22. In order to increase the holding force, either the size of connecting portion 24*c* or wing portions 24*e* must be significantly increased which, in turn, will undesirably increase the transverse dimensions of housing 22. This would be undesirable when miniaturization of coaxial cables is ever-increasing.

The present invention is directed to solving these various problems of increasing the holding forces and, particularly, the stability of a center terminal in coaxial electrical connectors.

SUMMARY OF THE INVENTION

An object, therefore, of the invention is to provide a new and improved coaxial electrical connector of the character described.

In the exemplary embodiment of the invention, the connector includes a dielectric housing having a front mating face and a rear face. A first, central terminal-receiving passage extends in a direction between the faces, along with at least one second, auxiliary terminal-receiving passage. At least one auxiliary terminal is received in the second passage. A center terminal is received in the first passage and includes an elongated mating portion projecting toward the mating face of the housing and defining a center axis. The elongated mating portion has a front mating end and a rear end. A terminating portion is spaced radially of the mating portion. A connecting portion joins the mating portion and the terminating portion. The connecting portion includes a stabilizing section which extends rearwardly along the axis from the rear end of the mating portion. The stabilizing section bears against a section of the first passage in the housing to stabilize the elongated mating portion of the center terminal.

According to one aspect of the invention, the elongated mating portion of the center terminal is cylindrical. The stabilizing section of the connecting portion is arc-shaped and generally coincident with the cylindrical mating portion. The center terminal may be stamped and formed of sheet metal material, and the arc-shaped stabilizing section thereby can be formed as a continuation of the cylindrical mating portion. As disclosed herein, the connecting portion of the center terminal is generally J-shaped and includes a plate section extending between the arc-shaped stabilizing section and the terminating portion of the center terminal.

Other features of the invention include the elongated mating portion of the center terminal including an angled barb near a rear end thereof for engaging an inside retaining surface of the first passage of the housing to retain the center terminal in the passage. The plate section of the J-shaped connecting portion of the center terminal includes a projection bearing against a wall of the first passage to further stabilize the mating portion of the center terminal. Both the center terminal and the auxiliary terminal include terminating portions formed as solder tails for electrical connector to a printed circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
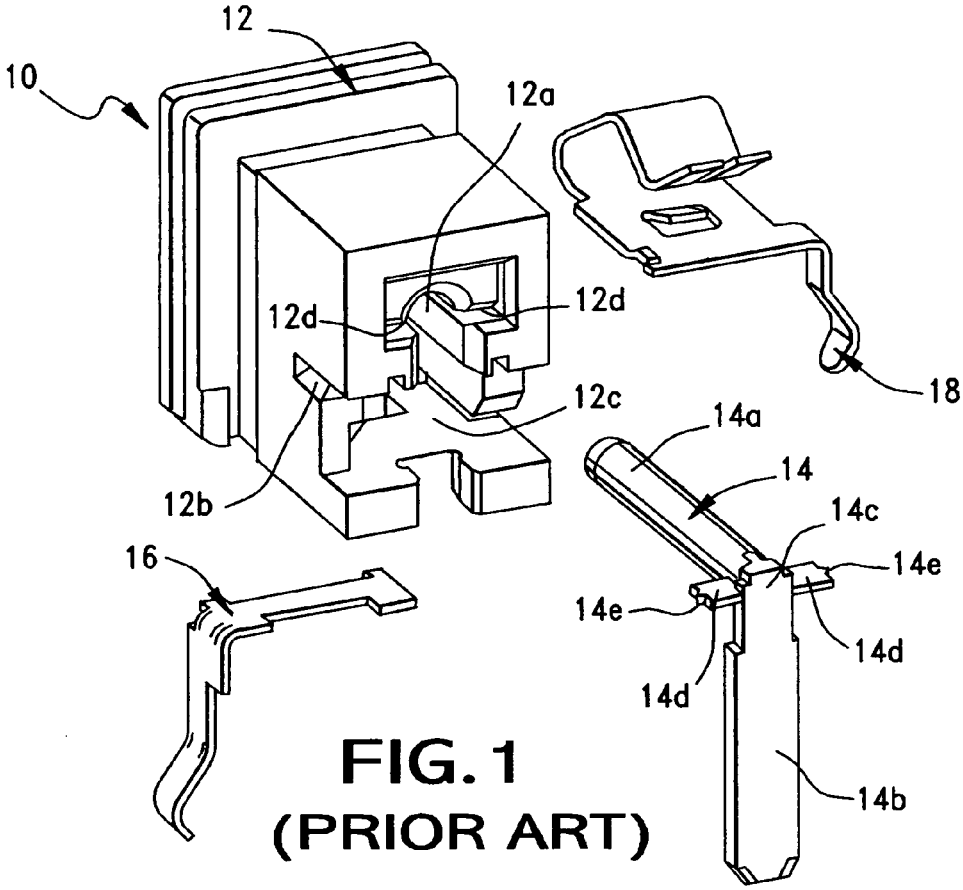
FIG. 1 (PRIOR ART)
FIG. 1 is an exploded perspective view of a prior art coaxial connector as described in the Background, above.
Figure 2:
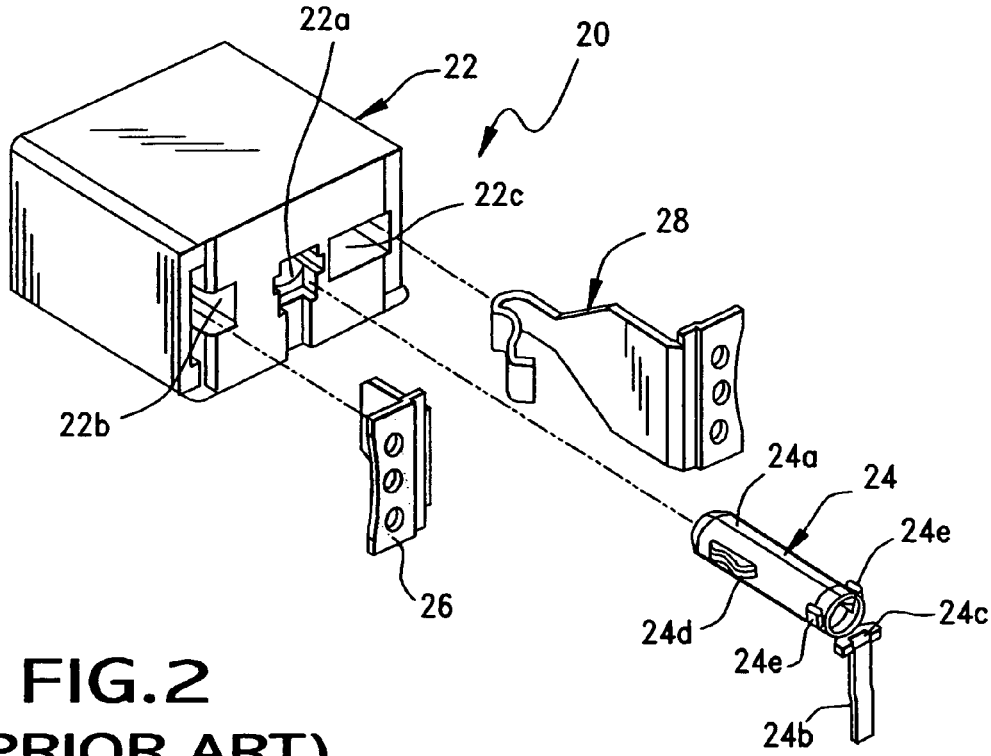
FIG. 2 (PRIOR ART)
FIG. 2 is an exploded perspective view of another coaxial connector according to the prior art and also described in the Background, above.
Figure 3:
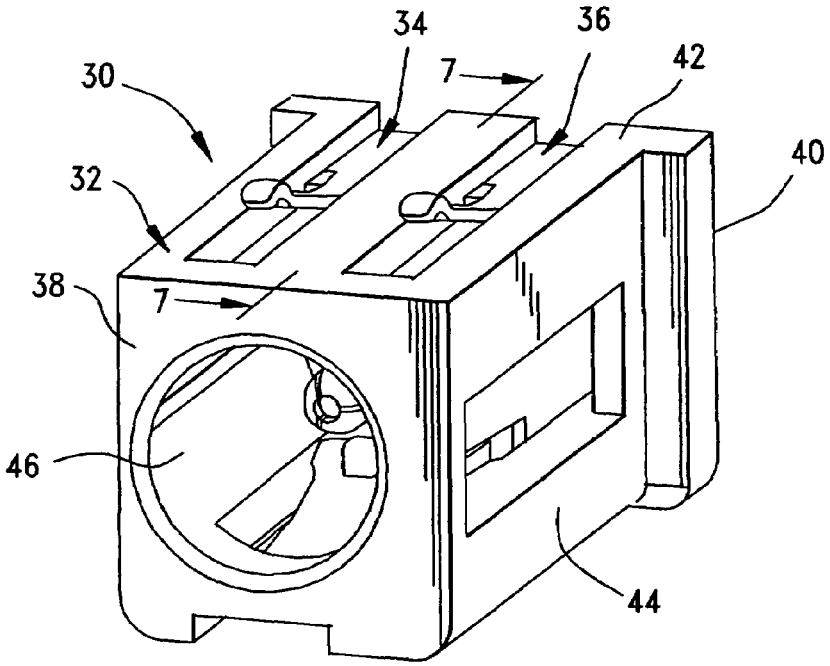
FIG. 3 is a perspective view looking at the front mating end of a coaxial connector according to the invention.
Figure 4:
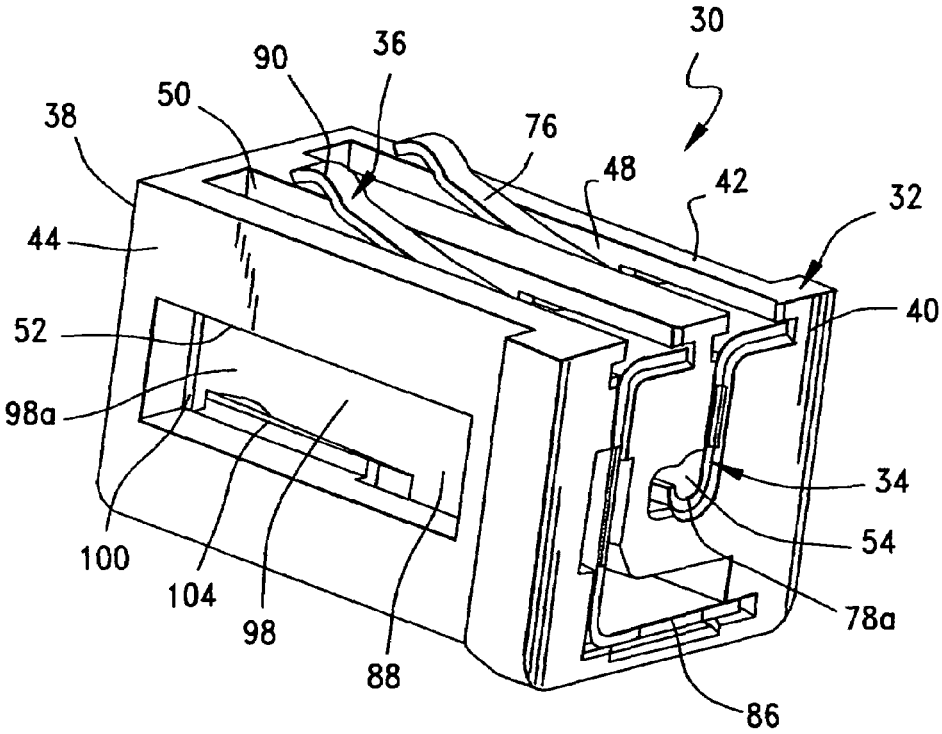
FIG. 4 is a perspective view looking at the rear end of the coaxial connector of FIG. 3.

Referring to the drawings in greater detail, and first to FIGS. 3 and 4, the invention is embodied in a coaxial electrical connector, generally designated 30, which includes a dielectric housing, generally designated 32, mounting a center terminal, generally designated 34, and an auxiliary terminal, generally designated 36.

Figure 5:
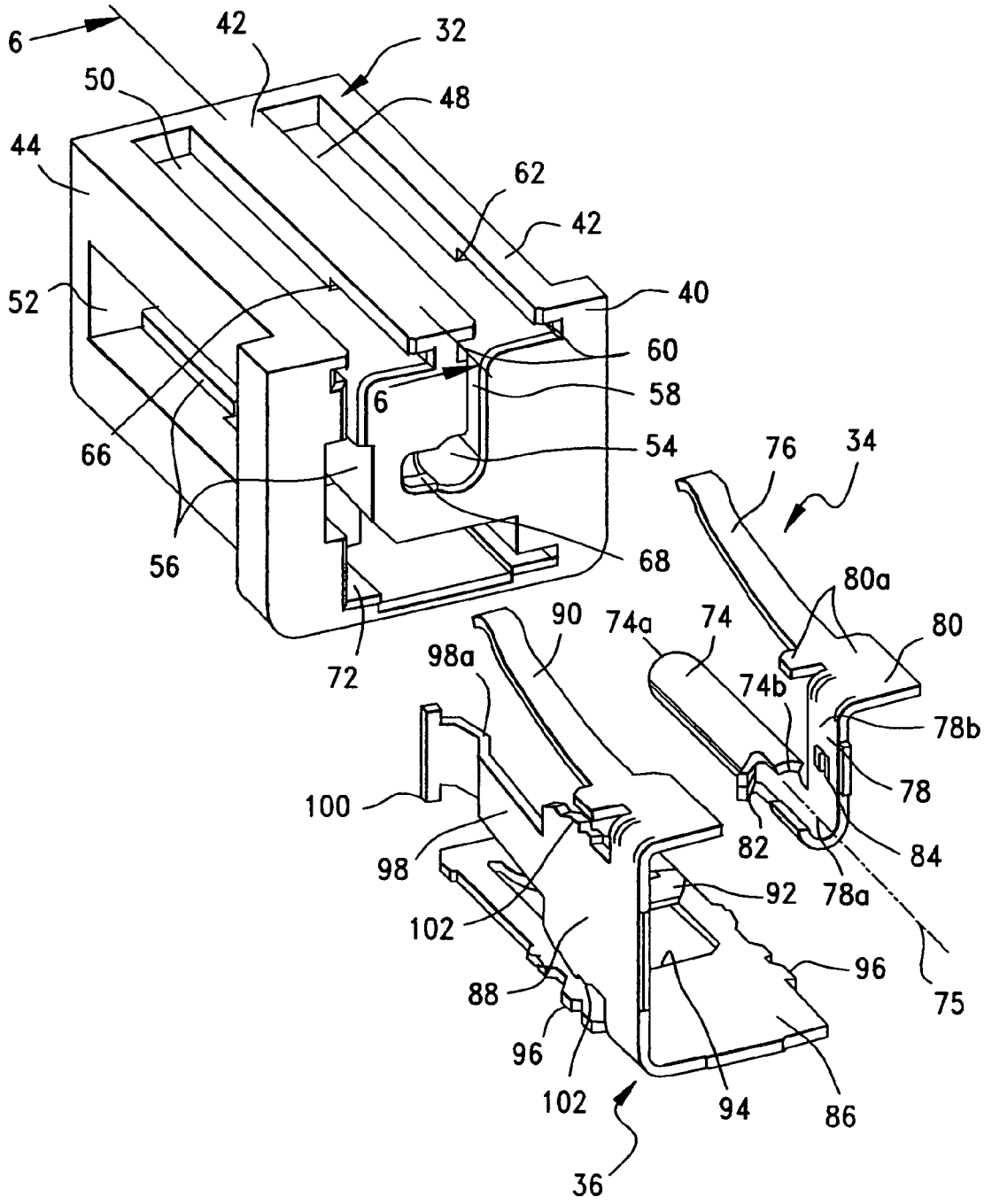
FIG. 5 is an exploded perspective view of the coaxial connector of FIG. 3.
Figure 6:
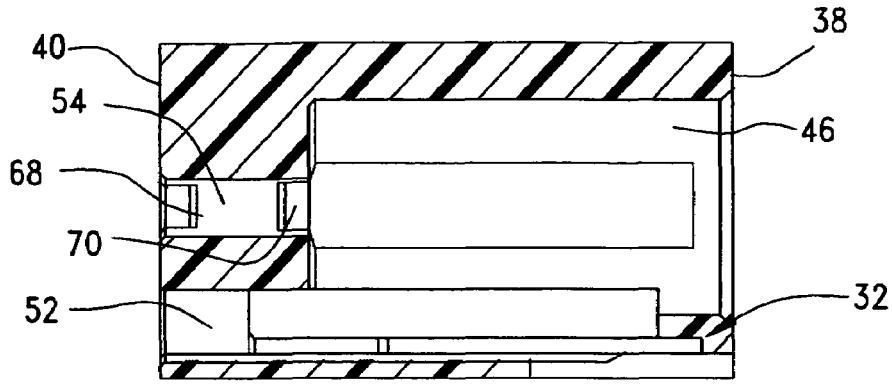
FIG. 6 is a vertical section taken generally along line 6—6 in FIG. 5.

Referring to FIGS. 3, 5 and 6, dielectric housing 32 has a front mating face 38 and a rear face 40. The housing may be molded of plastic material. A top face 42 and a side face 44 of the housing extend between the front and rear faces. A receptacle 46 opens at the front face of the housing for receiving a mating connecting device as described below in relation to FIG. 8. Top face 42 has a pair of elongated openings 48 and 50, and side face 44 has an elongated opening 52. A first, central terminal-receiving passage 54 extends in a direction between the front and rear faces of the housing and opens in the rear face as seen in FIG. 5. A second, auxiliary terminal-receiving passage 56 also opens at the rear face of the housing and extends thereinto generally parallel to first passage 54. As seen best in FIG. 5, a connecting slot 58 joins first passage 54 with elongated opening 48. A pair of holding grooves 60 are formed at opposite sides of elongated opening 48 and extend inwardly from rear face 40 to abutment shoulders 62. Similarly, a pair of holding grooves 64 are formed at opposite sides of elongated opening 50 and run from rear face 40 to abutment shoulders 66. The first, central terminal-receiving passage 54 has a side slot 68 (FIG. 5) which runs from rear face 40 to a retaining shoulder or surface 70 shown in FIG. 6. Finally, the second, auxiliary terminal-receiving passage 56 has a lower portion 72.

Referring to FIG. 5, center terminal 34 may be stamped and formed of conductive sheet metal material. The center terminal includes an elongated, cylindrical mating portion 74 defining a center axis 75. The mating portion has a semi-spherical front mating end 74*a* and a rear end 74*b*. A terminating portion in the form of a solder tail 76 is spaced radially from and extends generally parallel to cylindrical mating portion 74. A J-shaped connecting portion 78 joins mating portion 74 to terminating portion 76. The connecting portion has an arc-shaped stabilizing section 78*a* which extends rearwardly along axis 75 from rear end 74*b* of mating portion 74. The J-shaped connecting portion 78 has a plate section 78*b* which extends from the arc-shaped stabilizing section 78*a* to a horizontal or right-angled plate section 80 at the rear of terminating portion 76. Plate section 80 forms a pair of holding wings 80*a* which project outwardly from terminating portion or solder tail 76 at the rear end thereof. An angled barb 82 projects outwardly from cylindrical mating portion 74 near rear end 74*b* thereof. Finally, a bearing projection 84 projects transversely outwardly from plate section 78*b* of the J-shaped connecting portion 78 of center terminal 34.

Still referring to FIG. 5, auxiliary terminal 36 also is stamped and formed of conductive sheet metal material in a generally U-shape to include a bottom plate 86, a side plate 88 and a top terminating portion in the form of a solder tail 90. A spring contact portion 92 is formed out of an opening 94 in bottom plate 86. The bottom plate also has teeth 96 stamped out of the side edges thereof. Side plate 88 has a forwardly extending, cantilevered spring contact arm 98 formed with an inwardly bowed contact surface 98*a*. A support bar 100 is formed at the distal end of spring arm 98. Like bottom plate 86, side plate 88 is stamped with teeth 102 in the side edges thereof.

Figure 7:
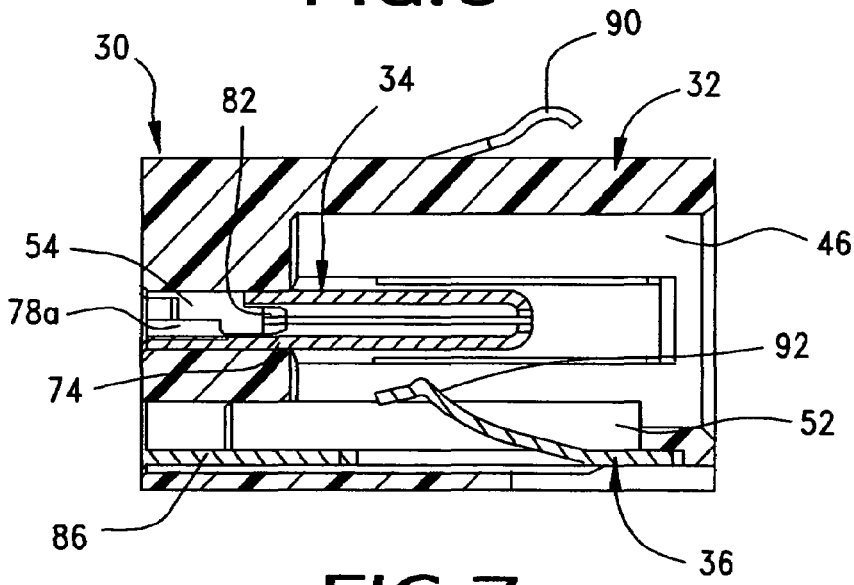
FIG. 7 is a vertical section taken generally along line 7—7 in FIG. 3.

Referring to FIGS. 4, 5 and 7, center terminal 34 is inserted into first passage 54 through rear face 40 of housing 32. The center terminal is inserted until cylindrical mating portion 74 extends forwardly toward the front mating face of the housing and into receptacle 46 as seen in FIG. 7. When fully inserted, angled barb 82 (FIGS. 5 and 7) snaps into engagement with retaining shoulder or surface 70 (FIG. 6) within passage 54 of the housing. Terminating portion 76 moves into the elongated opening 48 in top face 42 of the housing as seen in FIG. 4. The terminating portion projects upwardly or outwardly of the opening, as shown, for connection, as by soldering, to an appropriate circuit trace on a printed circuit board (not shown). When the center terminal is fully inserted into passage 54 as shown in FIGS. 4 and 7, it can be seen that the arc-shaped stabilizing section 78*a* of the terminal bears against a rear section of the passage. With the stabilizing section, in essence, being formed coincident with or as a continuation/extension of the cylindrical mating portion 74 of the terminal, this stabilizing section considerably stabilizes the mating terminal without having to enlarge the housing in a direction generally transversely of the mating portion (i.e., axis 75, FIG. 5).

Still further, when center terminal 34 is fully inserted into passage 54, holding wings 80*a* (FIG. 5) abut against abutting shoulders 62 of the housing at opposite sides of elongated opening 48, as plate section 80 ridges into holding grooves 60 at opposite sides of the elongated opening. Bearing projection 84 bears against a wall or surface of connecting slot 58. All of these interengaging components between the center terminal and the housing also ensure stabilization of the terminal, including terminating portion 76, to stabilize the current through the center terminal.

Auxiliary terminal 36 is inserted into passage 56 in housing 32 through rear face 40 of the housing. When inserted, bottom plate 86 of the terminal enters lower portion 72 of the passage and terminating portion 90 enters elongated opening 70 in the top face 42 of the housing whereby the terminating portion or solder tail 90 projects upwardly out of the opening as shown in FIG. 4, for connection, as by soldering to an appropriate circuit trace on the printed circuit board. As seen in FIG. 4, spring contact arm 98 is exposed within elongated opening 52 in side face 44 of a housing. Support arm 100 abuts against internal ledges 104 of the housing. When the auxiliary terminal is fully inserted into passage 56, teeth 96 at opposite edges of bottom plate 86 bite into the plastic material of the housing within lower portion 72 of the passage, while teeth 102 at opposite edges of side plate 88 also bite into the plastic material of the housing within passage 56 to solidly retain the auxiliary terminal within the passage. When the auxiliary terminal is fully inserted into passage 56, cantilevered spring arm 98 (with contact surface 98) projects into receptacle 46. Spring contact portion 92 also projects into the receptacle as seen in FIG. 7.

Figure 8:
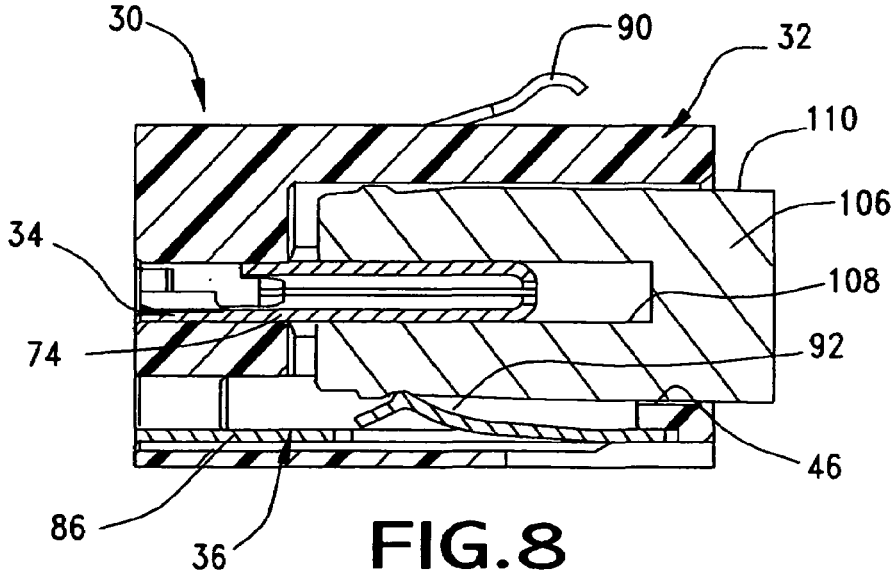
FIG. 8 is a view similar to that of FIG. 7, with a mating connecting device inserted into the connector.

FIG. 8 shows a mating connecting device 106 inserted into receptacle 46 of housing 32 of coaxial connector 30. The mating connecting device has a socket 108 for receiving cylindrical mating portion 74 of center terminal 34. The mating connecting device has an outer cylindrical surface 110 which engages spring contact portion 92 of auxiliary terminal 36. Although not visible in FIG. 8, contact surface 98*a* (FIG. 5) of cantilevered spring contact arm 98 also engages outer surface 110 of the mating connecting device. Although not visible in the drawing, a positive electrode will be provided within socket 108 for engaging mating portion 74 of center terminal 34, and negative electrode means are provided on outer surface 110 of the mating connecting device for engaging spring contact portion 92 and contact surface 98*a* of the auxiliary terminal.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A coaxial electrical connector (30), comprising:

a dielectric housing (32) having a front mating face (38) and a rear face (40), a first, central terminal-receiving passage (54) extending in a direction between said faces and at least one second, auxiliary terminal-receiving passage (56);

at least one auxiliary terminal (36) received in said second passage; and a center terminal (34) received in the first passage, the center terminal including:

an elongated mating portion (74) projecting toward the mating face of the housing and defining a center axis (75), the elongated mating portion having a front mating end (74*a*) and a rear end (74*b*);

a terminating portion (76) spaced radially of the mating portion; and a connecting portion (78) joining the elongated mating portion and the terminating portion, the connecting portion including a stabilizing section (78*a*) which extends rearwardly along said axis (75) from the rear end of the mating portion, the stabilizing section bearing against a section of the first passage (54) in the housing to stabilize the elongated mating portion of the center terminal, charactised in that:

said elongated mating portion (74) of the center terminal (34) is cylindrical, the stabilizing section (78*a*) of the connecting portion (78) of the center terminal is arc-shaped and generally coincident with the cylindrical mating portion, and said connecting portion (78) of the center terminal (34) is generally J-shaped and includes a plate section (78*b*) extending between the arc-shaped stabilizing section (78*a*) and the terminating portion (76) of the center terminal.

2. The coaxial electrical connector of claim 1 wherein said center terminal (34) is stamped and formed of sheet metal material, and the arc-shaped stabilizing section (78*a*) is formed as a continuation of the cylindrical mating portion (74).

3. The coaxial electrical connector of claim 1 wherein said elongated mating portion (74) of the center terminal (34) includes an angled barb (82) near a rear end (74*b*) thereof for engaging an inside retaining surface (58) of the first passage (54) in the housing (32) to retain the center terminal in the passage.

4. The coaxial electrical connector of claim 1 wherein the plate section includes a projection (84) bearing against a wall (58) of the first passage (54) in the housing to further stabilize the mating portion of the center terminal.

5. The coaxial electrical connector of claim 1 wherein the terminating portion of the center terminal comprises a tail portion (76) for electrical connection to a printed circuit board.

6. The coaxial electrical connector of claim 5 wherein said auxiliary terminal (36) includes a tail portion (90) for electrical connection to the printed circuit board.

* * * * *